United States Patent [19]

Richardson

[11] 4,008,342

[45] Feb. 15, 1977

[54] WOOD TREATMENT WITH AMMONIACAL LIQUOR AND CARBON DIOXIDE

[75] Inventor: Neil George Richardson, Montreal, Canada

[73] Assignee: Domtar Limited, Montreal, Canada

[22] Filed: May 1, 1975

[21] Appl. No.: 573,557

[52] U.S. Cl. ..... 427/297; 21/7; 427/333; 427/343

[51] Int. Cl.[2] ..... B05D 3/00

[58] Field of Search ..... 21/7; 427/297, 333, 427/343

[56] References Cited

UNITED STATES PATENTS

| | | | |
|---|---|---|---|
| 675,826 | 6/1901 | Geisler | 427/297 X |
| 679,739 | 8/1901 | Geisler | 427/297 X |
| 1,680,529 | 8/1928 | Richter et al. | 427/297 |

*Primary Examiner*—Michael R. Lusignan
*Attorney, Agent, or Firm*—C. A. Rowley

[57] ABSTRACT

A method of preventing the deposition of preservative solids onto the surface of the material being treated from an ammoniacal treating liquor of the type wherein deposition of the treating chemical within the wood requires evaporation of the ammonia from the solution. After the impregnation treatment the wood is contacted with an atmosphere containing carbon dioxide in an amount and for a time sufficient for the carbon dioxide to combine with a significant amount of the ammonium hydroxide in the treating liquor on the wood to form ammonium carbonate and/or bicarbonate and thereby inhibit the loss of ammonia from the liquor for a time sufficient for the liquor on the wood to migrate into the wood.

10 Claims, No Drawings

WOOD TREATMENT WITH AMMONIACAL LIQUOR AND CARBON DIOXIDE

The present invention relates to a method of treating wood. More specifically, the present invention relates to a method of treating wood with an ammoniacal liquor containing treating chemical to produce a treated product having a clean surface.

In the processes of treating wood by impregnation with ammoniacal liquors containing treating chemicals such as copper or zinc arsenic compositions or the like is to place the wood in a pressure vessel, subject the wood to a negative pressure, introduce a treating chemical in sufficient quantity to essentially fill the pressure vessel, maintain an elevated pressure in the vessel for sufficient time to impregnate the wood with the requisite amount of treating chemical, release the pressure and withdraw the excess liquor from the treating vessel followed by withdrawal of the impregnated material from the vessel.

This procedure results in the surface of the treated wood being marred by unsightly stains or blotches which detracts from the appearance of the product. These stains have been found to be due to deposition of preservative solids on the surface of the wood as the surface film solution loses ammonia. These deposits are objectionable not only on aesthetic grounds but also because they represent the loss of chemical as the chemical deposits on the surface of the material serve no useful function.

Thus, it is the main object of the present invention to minimize the amount of deposits and provide a relatively clean product.

It is found that a clean product will be obtained and the deposits substantially eliminated by subjecting the wood, after termination of the pressure treatment and withdrawal of the excess liquor, to an after-treatment in an atmosphere containing carbon dioxide for a short period of time (at least two minutes) to permit the carbon dioxide in the atmosphere to combine with the ammonia in the treating solution on the surface of the wood to form ammonium carbonate and/or bicarbonate. Thereafter the treated wood may be withdrawn from the treating vessel and dried in the conventional manner. The ammonium carbonate and/or bicarbonate formed by the reaction of ammonia and carbon dioxide in solution inhibits the evaporation of ammonia from the treating solution for a time sufficient to prevent deposition of preservative solids before the liquor on the surface of the wood migrates into the wood.

The term "clean" is intended to define a condition wherein the surface of the wood appears like coloured wood and shows substantially no evidence of dust. The difference between a "clean" surface and conventionally treated wood is quite pronounced.

Broadly, the present invention relates to a wood treating process comprising charging wood to be treated into a pressure vessel, closing the vessel, submerging the wood in an ammoniacal treating liquor wherein the ammonia serves to solubilize the treating chemicals, for example, copper or zinc arsenate in solution, maintaining an elevated pressure in the vessel thereby to impregnate the wood with the requisite amount of liquor, releasing the pressure in the vessel, withdrawing excess liquor from the vessel, some of said liquor remaining on said wood injecting a gas containing $CO_2$ into the vessel, the amount of $CO_2$ in the atmosphere surrounding the wood in the vessel and the time of contact being sufficient for the $CO_2$ to combine with a significant amount of the ammonia in said treating liquor remaining on said wood to form ammonium carbonate and/or bicarbonate thereby to retard evaporation of ammonia from said liquor on said wood and to prevent precipitation of the preservative solids onto the surface of the wood, withdrawing the treated wood from the treating vessel and drying in the conventional manner.

In cases where the material being treated is tightly packed the surfaces may not all be accessable to the carbon dioxide. In these cases it is important that the material be retained in packed condition after removal from the cylinder, for a time sufficient to permit migration of treating chemical into the wood.

It has been found that atmospheres containing as low as ten per cent (10%) by weight carbon dioxide in the atmosphere may be used with the minimum amount of carbon dioxide permissible being dependent on the size of the treating vessel, the size of the charge, the exposed area of the charge, and the amount of liquor lying on the surface of the treated material after impregnation. The time of contact will normally exceed 2 minutes. Preferably the atmosphere will contain greater than 20% carbon dioxide.

It is believed that the mechanism of the process of the present invention involves a temporary fixation of the ammonia in the solution on the surface of the wood by the formation of ammonium salts of carbonic acid. Thus, on removal of the treated wood from the treating cylinder any surface excess of treating solution has time to be incorporated into the surface of the wood before substantial loss of ammonia occurs which would result in deposition of the preservative solids on the surface. Fixation of ammonia as ammonium salts of carbonic acid is only a temporary phenomenon and does not interfere with the ultimate fixation of the preservative.

In a commercial installation the carbon dioxide may be introduced into the cylinder in the air replacing the liquor as the cylinder is drained or preferably may be added after the cylinder has been drained. The cylinder may be emptied in the usual way, a slight vacuum applied and the pressure raised or returned to atmospheric by the introduction of carbon dioxide or after the cylinder has been emptied the pressure may be raised by adding carbon dioxide. It will be apparent that the amount of carbon dioxide in the air surrounding the treated material must be sufficient to prevent rapid evaporation of ammonia from the surface of the liquid lying on the treated wood after draining of the cylinder and thus will depend on the volume of the vessel used for the carbon dioxide treatment, the surface area of the wood being subjected to the post treatment with carbon dioxide, the amount of liquor remaining on the surface of the wood after treatment and the air velocity in the final drying operation. The time required for contact of the liquor remaining on the surface of the treated wood with carbon dioxide must be sufficient for the required amount of carbon dioxide to dissolve and to form the ammonium carbonate and/or bicarbonate.

Further features, objects and advantages of the present invention will be obvious from the following examples of specific experiments carried out in accordance with the present invention.

EXAMPLE 1

Six pieces of Douglas-fir plywood (4 × 4 × ½inch) were treated in a pilot plant treating cylinder by evacuating the vessel, introducing the treating solution comprising an ammoniacal water solution sold under the trademark "Chemonite" and containing copper arsenate and ammonium hydroxide, there being sufficient ammonium hydroxide to maintain the copper arsenate in solution, i.e. a weight ratio of ammonia to copper expressed as copper oxide of 1.8 to 1. The concentration of copper arsenate was three per cent (3%).

The treating vessel was first evacuated and then the treating solution at 100° F was introduced and this temperature at a pressure of 80 psi was maintained for four hours. The pressure was then returned to one atmosphere and the solution drained from the cylinder. Three of the pieces of treated wood were immediately transferred to a desiccator which had a volume of about 9 liters which had previously been filled with a carbon dioxide/air mixture containing about 90% by weight of carbon dioxide. The treated wood was left in the carbon dioxide atmosphere for two minutes, after which time the wood was placed to dry in a slight draught to simulate normal outdoor conditions. The remaining three pieces in the treating cylinder were also positioned to dry as control samples. After drying overnight, there was a pronounced difference between the carbon dioxide-treated pieces, which were clean, and the control pieces which had a light surface coating of preservative solids.

The above experiment was repeated using carbon dioxide/air mixtures containing 60%, 34% and 15% of carbon dioxide on a weight basis. The results were essentially as described above.

A residence time of 30 seconds was used with a 60% carbon dioxide atmosphere and the product was found to be slightly dusty but still considerably cleaner than the control material.

EXAMPLE 2

A similar experiment to that described in example 1 was conducted but on Lodgepole pine lumber (1.5 × 4 × 4 inch) in place of the plywood and using a residence time of three minutes in a 60% carbon dioxide atmosphere. The product produced was a clean greenish-brown after drying, in contrast to the control which was green due to the presence of a coating of preservative solids.

EXAMPLE 3

Douglas-fir plywood was treated in the same manner as described in Example 1 with the exception that the pressure during the impregnation stage was 100 psi. Six pieces of (18 × 4 × ½inch) were treated in a pilot plant cylinder which had an internal diameter of 8 inches and a length of 4 feet. After treatment the plywood was removed from the cylinder and placed in a polyethylene bag. The cylinder was then filled with carbon dioxide/air mixture containing 60% by weight of carbon dioxide. Three of the treated pieces were quickly transferred to the cylinder and left for 3 minutes. These pieces, and the three remaining pieces which had not had the carbon dioxide treatment were then placed in a fume hood to dry under a slight draft. After drying, the carbon dioxide treated pieces were completely free of surface deposits of preservative solids whereas the control pieces were lightly coated with green dust.

EXAMPLE 4

Bundles of six Douglas-fir plywood sheets (4 × 18 ½inch) were treated at 100° F using 100 psi for 4 hours. After treatment, the cylinder was drained with simultaneous introduction of a carbon dioxide/air mixture containing 18% of carbon dioxide. After drying of the treated wood, it was found to be slightly dusty.

The above experiment was repeated using a 37% by weight carbon dioxide/air mixture. A similar result was obtained. Only when pure carbon dioxide was used to replace the treating solution during draining of the cylinder was a clean product obtained after drying. This was presumably because much of the carbon dioxide was being dissolved in the treating solution during emptying of the cylinder.

EXAMPLE 5

Bundles of Douglas-fir plywood were treated as above and the cylinder was drained in the usual way. A tube was then positioned in the back of the cylinder in order to deliver a stream of gas containing 20% by weight of carbon dioxide in air. The door of the cylinder was partly sealed to prevent entry of air. The gas flow was adjusted to deliver one cylinder volume in 10 minutes. After this treatment, the wood was removed and allowed to dry at room temperature in a slight draught. The product was found to be very slightly dusty.

When the above experiment was repeated using a similar air flow for twenty minutes instead of ten, the wood was free from surface deposits after drying.

EXAMPLE 6

Two bundles of Douglas-fir plywood containing six pieces each (4 × 18 × ½inch) were treated at 100° F using a pressure of 100 psi for 4 hr. One of the bundles was removed and placed in a polyethylene bag as a control. The pressure in the cylinder was then reduced by 5 inches of mercury from one atmosphere and immediately brought back to one atmosphere with carbon dioxide gas. This gave a mixture containing about 23% by weight of carbon dioxide in the cylinder. After a residence time of 10 minutes, the bundle in the cylinder was removed and positioned to dry, as a bundle, in a slight draught of air. The bundle was removed from the polyethylene bag and positioned to dry in a similar draught of air. After drying, the carbon dioxide-treated material was completely clean, while the control material was slightly dusty.

Modifications may be made without departing from the spirit of the invention as defined in the appended claims.

I claim:

1. A method of treating wood with an aqueous ammoniacal treating liquor wherein ammoniacal chemical serves to solubilize a water-insoluble wood treating chemical, comprising charging the wood to be treated into a pressure vessel, submerging the wood in said ammoniacal treating liquor, maintaining an elevated pressure in said vessel thereby to impregnate said wood with a requisite amount of said liquor, releasing said pressure, withdrawing excess of said liquor from said vessel, some of said liquor remaining on surface of said wood, subjecting said wood to an atmosphere containing carbon dioxide in an amount and for a time sufficient for said carbon dioxide to combine with the ammonia in said liquor remaining on said surface to form a member of the group consisting of ammonium carbonate and ammonium bicarbonate in an amount sufficient to substantially prohibit subsequent deposition of said treating chemical until substantially all of said liquor on said surface of said wood has disappeared.

2. A method as defined in claim 1 wherein said carbon dioxide content of said atmosphere is at least 10 per cent (10%) by weight of said atmosphere.

3. A method as defined in claim 2 wherein said time is at least 2 minutes.

4. A method as defined in claim 3 wherein said concentration of carbon dioxide in said atmosphere is at least twenty per cent (20%) and wherein said time is at least 2 minutes.

5. A method as defined in claim 1, wherein said wood is subjected to said carbon dioxide atmosphere in said vessel after substantially all of said treating liquor with the exception of that remaining on the surface of the wood has been withdrawn from said vessel.

6. A method as defined in claim 4 wherein said treated wood is contacted with said atmosphere containing carbon dioxide after substantially all of said liquor with the exception of that remaining on the surface of the wood has been withdrawn from the cylinder.

7. A method as defined in claim 1, wherein said treated wood is subjected to a negative pressure and is then treated with said atmosphere containing carbon dioxide.

8. A method as defined in claim 1, wherein said carbon dioxide atmosphere is introduced to said vessel to replace said treating chemical as said treating chemical is withdrawn from said vessel.

9. A method as defined in claim 1, wherein the introduction of said carbon dioxide atmosphere raises the pressure in said vessel.

10. A method as defined in claim 4 wherein said treated wood is subjected to a negative pressure and is then treated with said atmosphere containing carbon dioxide.

* * * * *